United States Patent [19]

Bujese

[11] 4,354,759

[45] Oct. 19, 1982

[54] COPY PAPER FEED MECHANISM

[75] Inventor: David P. Bujese, Toms River, N.J.

[73] Assignee: Pitney Bowes Inc., Stamford, Conn.

[21] Appl. No.: 259,397

[22] Filed: May 1, 1981

[51] Int. Cl.[3] ..... G03G 15/00; B65H 5/04

[52] U.S. Cl. ..... 355/3 SH; 355/14 SH; 271/10; 271/18; 271/264

[58] Field of Search ..... 355/3 SH, 3 R, 14 SH; 271/233, 240, 251, 264, 265, 10, 18, 21, 174, DIG. 2

[56] References Cited

U.S. PATENT DOCUMENTS

| | | | |
|---|---|---|---|
| 3,632,201 | 1/1972 | Granzow et al. | 355/3 SH |
| 3,659,938 | 5/1972 | Fujimoto | 355/3 SH |
| 4,163,549 | 8/1979 | Ito et al. | 271/174 |
| 4,172,653 | 10/1979 | Bujese | 355/3 SH |
| 4,181,424 | 1/1980 | Okada et al. | 355/3 SH X |
| 4,188,028 | 2/1980 | Miciukiewicz | 271/265 |

*Primary Examiner*—A. C. Prescott

*Attorney, Agent, or Firm*—Martin D. Wittstein; William D. Soltow, Jr.; Albert W. Scribner

[57] ABSTRACT

Disclosed is an apparatus for feeding a sheet of copy paper to the photoconductive drum in a photocopier machine. The apparatus includes sheet separating means, sheet feeding means and drive means alternately disposed between one of two positions for successively causing sheet separation and feeding of a sheet of copy paper from a stack to a registration position synchronized with a developed image rotatably carried on the photoconductive drum. The apparatus also includes an actuating linkage arrangement for effecting one of two positions of the drive means, through motion caused by cams attached to the reciprocating original document carriage.

7 Claims, 6 Drawing Figures

COPY PAPER FEED MECHANISM

BACKGROUND OF THE INVENTION

The present invention relates to a sheet feeding apparatus for an electrostatic copying machine or the like.

In an electrostatic copying machine, the feeding of sheet copy paper is an important functional requirement among many, each of which is essential to provide a duplicate copy, or copies of an original document.

The means for accomplishing separation and feeding of a single copy sheet is relatively well known within the copier field. Usually, a pair of round wheels, fabricated from highly frictionable material are rotatably driven for the purpose of separating and advancing single sheets of copy paper seriatim from the supply stack held within a tray or cassette.

Once separated from the stack, the single sheet is further advanced by the separator feed wheels to a registration gating device for alignment and timing purposes.

From the registration gate area, the sheet is transported further through the use of additional transport rollers or belts which are arranged in the path of travel for that purpose. Each sheet is finally directed towards the process portion of the copier where transfer of the developed image occurs. In order to achieve precise duplication, the timely arrival of the leading end of each copy sheet must precisely register with the leading edge of the developed image being carried upon the photoconductor. If there is any mismatch in the relationship of the developed image to the copy sheet, an undesirable effect is immediately seen by the machine operator, not having received the desired duplicate copy of the original document.

In order to achieve registration of the copy sheet to the developed image, various arrangements of gating mechanisms or synchronous sheet feeding rollers are used. These devices are used in combination with a slight resilient buckle induced into the leading portion of the sheet in order to ensure registration. Once the leading end of the copy sheet does communicate with the developed image, the transfer portion of the copier process proceeds until all of the image is transferred to the sheet.

While the registration gate is provided in several different forms, one of the most common involves the use of sheet feeding rollers. These rollers are usually kept stationary during a part of the initial feeding stage of the copy sheet. Then, at a predetermined time, when the sheet is registered the stopped sheet feeding rollers are rotatably engaged through a clutching device.

Another form of registration gate comprised of mechanical fingers is used where the fingers are raised from the path of the stopped sheet at a predetermined time when a mechanically connected actuator is energized. Usually, the sheet feeding rollers used with this system do not stop, and a certain amount of slippage upon sheets is permitted to allow the rollers to continue running, thereby eliminating errors in registration due only to inertial considerations.

In any case, the sheet registration gate provides a means to straighten out any skew inherent in the copy sheet, prior to advancement to the transfer function in the process. Also, the resilient buckle provided in the leading edge of each temporarily stopped sheet, provides an opportunity for the sheet's leading edge to assume a parallel alignment with respect to the gate.

The imposed buckle also insures that the sheet's lead edge is positioned at the roller nip for further positive advancement to the process area.

Since the transferred image is not permanent, a further transport system engages the copy sheet on the non-image side, thereby conveying the sheets seriatim to the fixing stage of the copying process.

The drive apparatus for advancing the sheets typically includes rotatable members actuated by electromagnetic clutching devices, which are usually driven from an endless drive member such as a chain which transmits power for other components within the copier. There are also similar rotational control clutching devices in the form of wrap spring clutches which are actuatable by separate electrically powered delatching devices. These electrical clutching devices require a means of energization from a main power source, as well as logic and circuitry, all of which contribute to the complexity and cost of manufacturing, assembly and servicing of a copier machine.

While the clutching devices previously described are practically used as standard equipment in copiers, and used to accomplish all of the separation, feeding and advancement of copy sheets, as well as other functions, these devices are expensive and space consuming. It is also fairly complex to provide means for timing the clutches so that registration is endlessly repeatable in a stream feeding situation where multicopy is required by a machine operator. There are adjustments provided within the electromagnetic clutch systems which correct for error, or an adjustment may be accomplished through a paper sensing switch located to feed the position of the sheets in their respective paths of travel. The paper sensing switch adjustments are especially difficult to achieve, and require complicated assembly procedures as well as access and procedures for service requirements.

Prior Art

U.S. Pat. No. 4,009,957 to Suyuki et. al. provides an example of an electrophotographic copier utilizing mechanisms comprised of lever arms, two-way pawls and associated electro-mechanical actuators all arranged for the purpose of feeding cut copy sheets. In one embodiment, a double set of sheet feeding mechanisms are actuated from a follower roller mounted on an external reciprocating carriage. In the invention, the first mechanism controls the separation and feed of each sheet while the second controls registration and transport to the transfer station. There are also described, delatching devices working in combination with wrap spring clutches, used to control rotation of the separator wheels to specific angular limits.

SUMMARY OF THE INVENTION

The present invention provides a simplified mechanical means to separate, advance and register sheets of copy paper from a supply stack. The apparatus includes a train of linkage actuated by an abutment formed from cams attached to the external reciprocating carriage. The linkage includes pivotable lever arm assemblies, a connecting link with a built-in lost motion device, and a positionable drive means all connectively engaged and biased in one direction. While the sheet feeding means normally continuously rotates at constant speed, the positionable drive means also continuously runs. When the drive means is shifted to a second position, actuation caused by said abutment, causes separation of a copy sheet from the stack, advancement to the sheet feeding means, a resilient buckle, and finally, registration control for matching a developed photoconductor image.

OBJECTS OF THE INVENTION

An object of the present invention is to provide further improvements in the instrumentalities for controlling the separation of copy paper in a copier machine.

Another object is to provide a means for controlling the amount of buckle induced into a registered copy sheet.

Another object is to provide a means for accomodating the initial shock and subsequent translation of motion induced from a cam engaging paper feed actuating devices.

Yet another object is to provide an improved copy sheet drive control means.

And yet another object is to provide a means for intermediately positioning the copy sheet drive control means between the separation and sheet feeding means.

DETAILED DESCRIPTION

Figure 1:
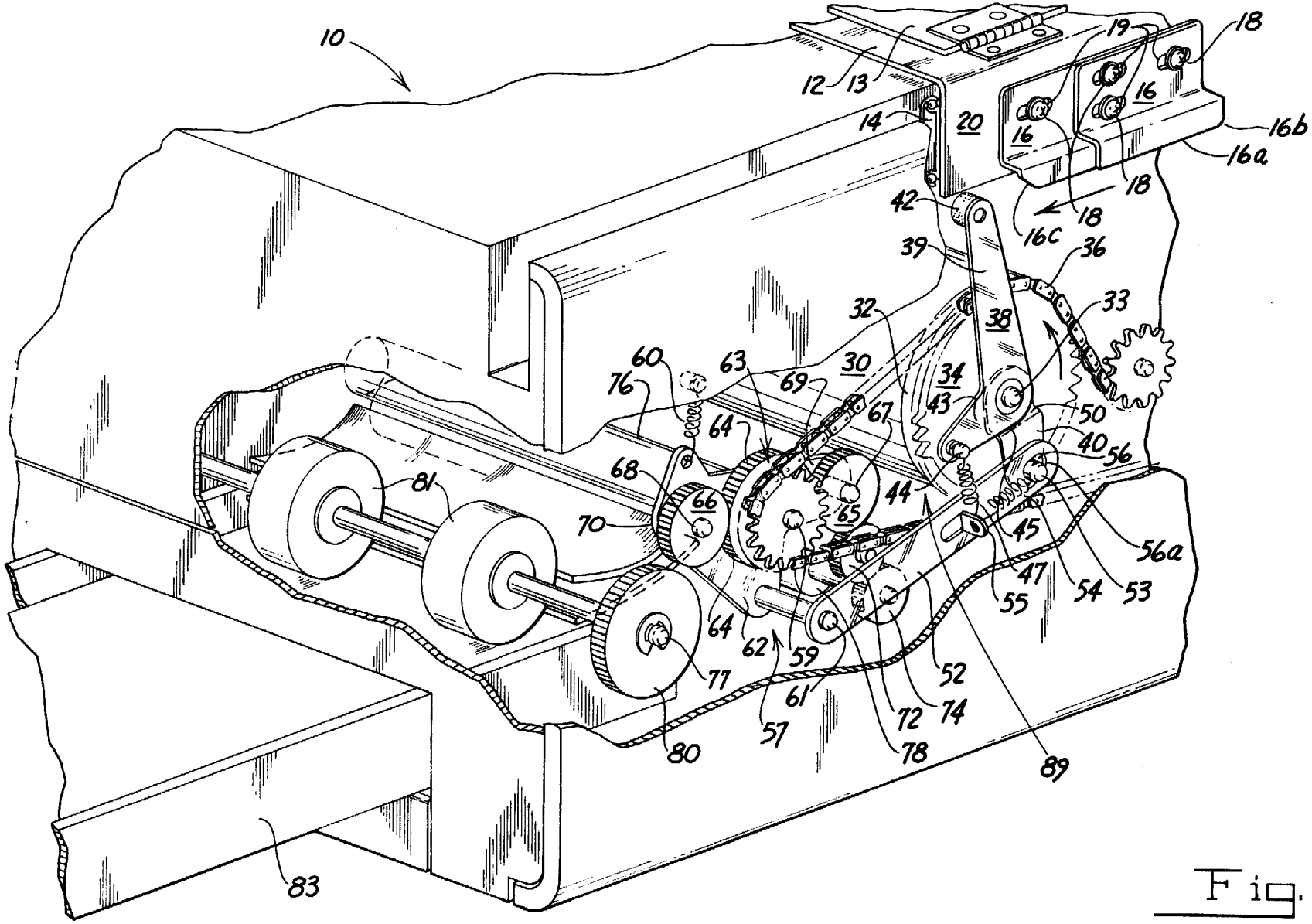
FIG. 1 is a partial perspective view of a copying machine illustrating a preferred embodiment of the present invention.

Referring now to the drawings and particularily to FIG. 1, the reference numeral 10 generally designates a photocopying machine 10. The copier 10 has an external reciprocating carriage 12, located on top of the copier framework for the purpose of holding an original document during the scanning portion of the copier process. An original document (not shown) is placed face down under the original document carriage flap 13 which secures the document during the reciprocal carriage scan and retrace motion.

A carriage 12 is slidably attached and suspended by means of drawer slides 14 which are conveniently attached to the copier framework (not shown) and also to the carriage assembly 12. Also attached to the carriage assembly 12 is a two piece abutment which forms an adjustable sheet metal cam arrangement 16. The cams 16 are similarily shaped, and fit together snugly for the purpose of providing a smooth continuous surface **16*a* for a cam follower 42. The cams 16 also have slots 19 to permit a two-way adjustment with respect to the original holding carriage, the cam follower 42, and all related mechanisms. Screws 18 typically clamp the cams 16 to a vertical flange 20 of the carriage assembly 12**.

Figure 2:
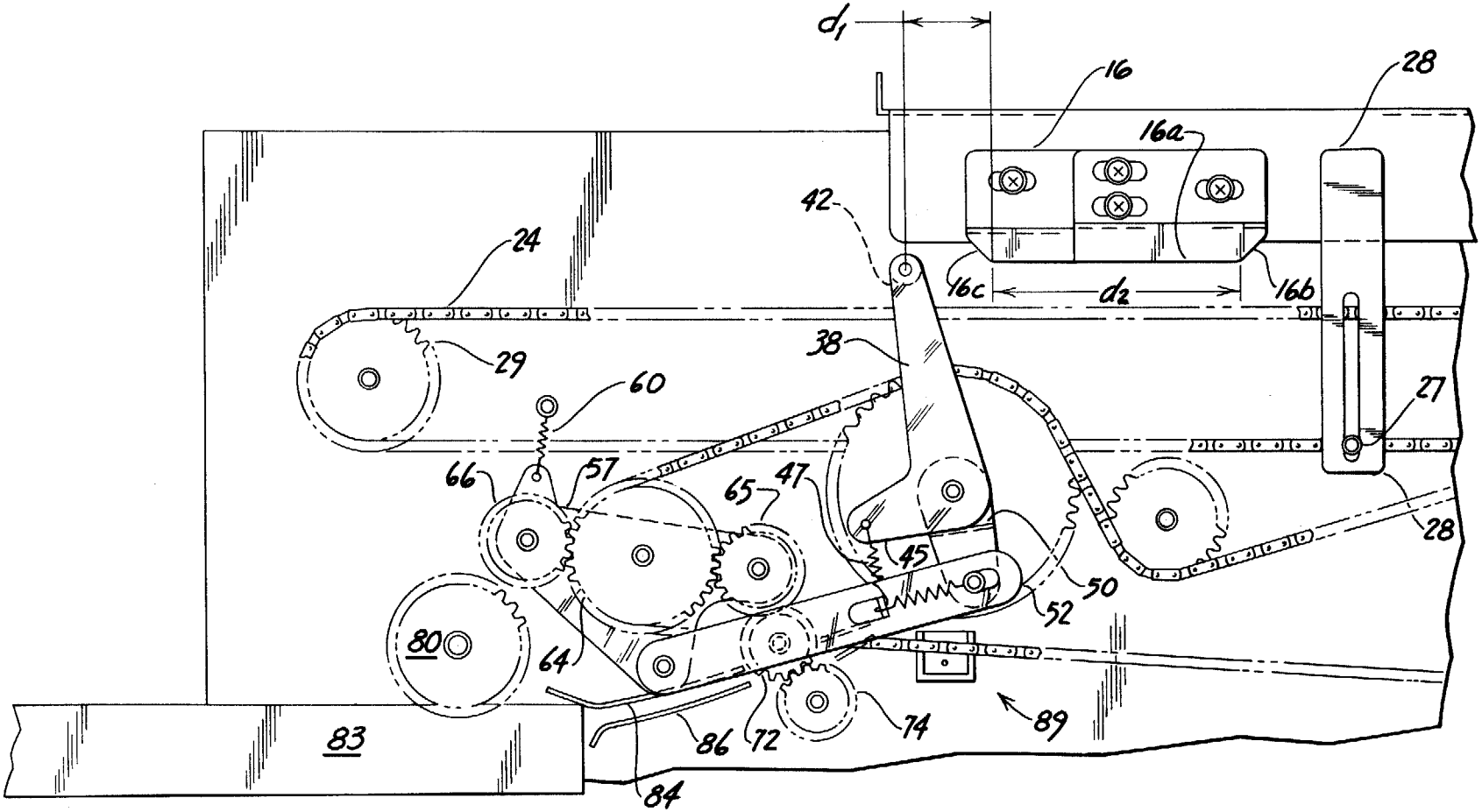
FIG. 2 is a partial front view of the copy machine shown in FIG. 1 illustrating the parts in the positions taken with the sheet feeding means operating, and the sheet separating means inoperative.

Within FIG. 2, an endless chain drive member 24 is shown rotatably supported on sprocket bars 25 and 26 mounted upon the copier side frames (not shown).

A pin 27 protrudes from the drive chain member 24 so that it engages a slotted carriage follower bracket 28, (which is suitably fastened to the carriage 12). While the machine runs, the carriage drive chain member 24 endlessly rotates in one direction, driven by suitable connection to the main copier machine AC gear motor, which typically provides rotary power for all internal endless drive members.

In addition, the copier 10 is provided with a photoconductor support drum 32, which has a suitable photoconductor image receptor such as selenium provided on its outer surface. The drum 32 is appropriately rotatably suspended at each end by journals, (not shown), so that the drum is located within the copier side frames. On one end of the photoconductor support drum 32, a sprocket member 34 is attached to the drum for the purpose of transmitting rotary motion from an endless drive chain member 36. Also, shaft 33, which supports the drum 32 within the copier frames, provides a convenient pivot journal for the lever arm assemblies 38 and 40 which are provided with suitable bearings co-axially located with the drum support shaft 33.

Figure 6:
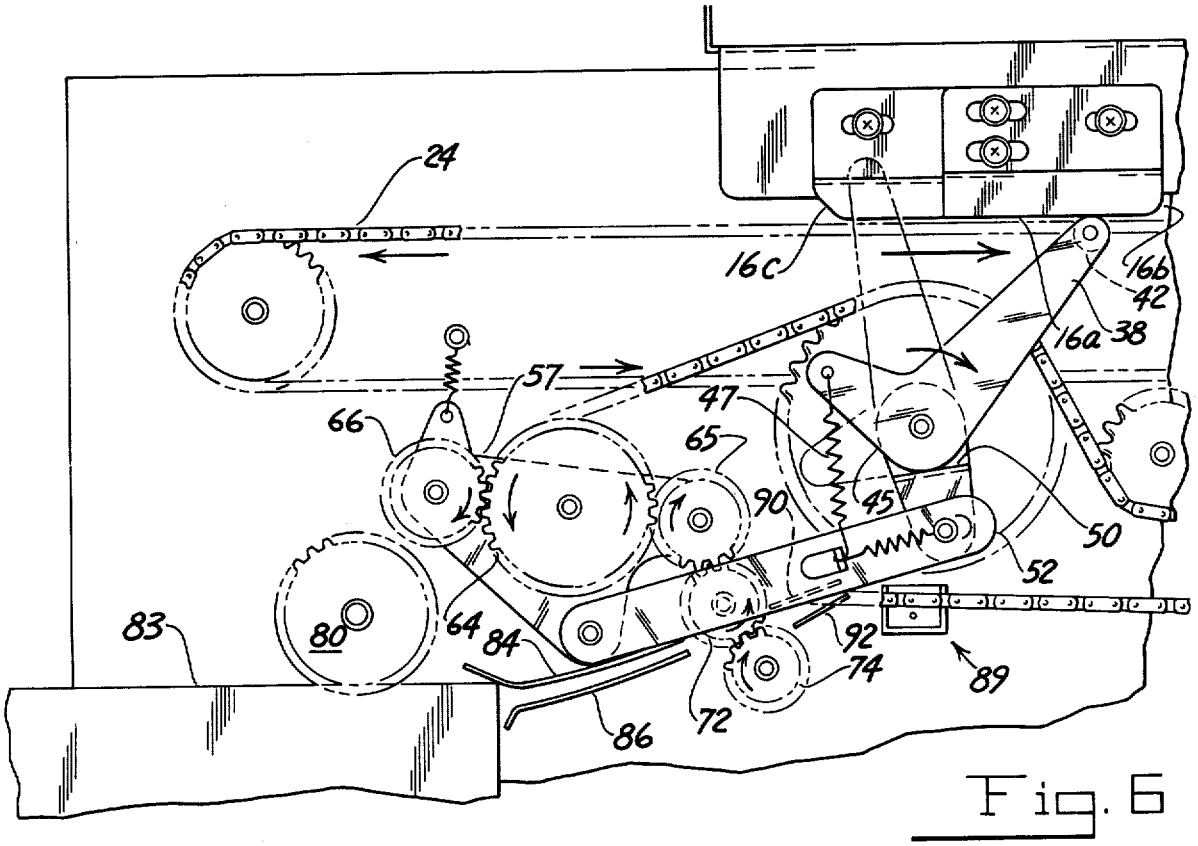
FIG. 6 is a partial front view similar to FIG. 2 illustrating the parts in the positions taken during return movement of the carriage.

A lever assembly 38 is bellcrank in shape, and has one upright arm 39 for the purpose of holding the cam follower 42 which centrally aligns with the cams 16 when viewed from either end of the copier machine. The second arm 43 of the member 38 has a spring pin 44 rigidly fastened at the end of arm 43 in order to provide attachment for a spring member 47. The spring 47 allows the lever arm assembly 38 to yield in a clockwise direction under influence of the return stroke of the carriage 12 towards the right (FIG. 6).

Best seen in FIGS. 1 and 2 we see that, initially, during the scanning portion of the reciprocating stroke of the carriage 12, the cams 16 engage the follower 42 on the cam 16 surface **16*c*, after traveling through a predetermined distance $d_1$. Meanwhile, the carriage 12 continues from right to left, and the original document carried on the carriage 12 is illuminated. During this time, the image of the original is progressively projected through the copier optics system (not shown), and is eventually received upon the photoconductor 30** which is sensitized in advance by xerographic means (not shown).

In order to introduce copy sheets into the system, sheet separation function is initiated by motion urged through the lever assembly 38, which rotates CCW under influence of the cams 16. At this time, a surface 45 of the lever arm assembly 38 engages a mating surface 50 of a lever assembly 40, thereby causing a resiliently connected link 52 to be carried in a left to right direction until the lost motion within a slot 56 provided within the link 52 is substantially taken up between a pin 53 and the end of the slot 56 at **56*a*. It should be pointed out that the slot 56 cooperates with the connected actuated apparatus to allow a yield to occur in the event of a misadjustment. For example, if the drive gears 66 and 80 engage to the point where gear teeth mash against the tooth space of the mating gear, it is desirable that the space at the end of slot 56 take up the resulting interference through the spring 54. This motion is opposite in direction in reference to the scanning carriage motion at this time. A spring 54 is connected between a spring stud 53 and a spring tab 55, the stud 53 being permanently attached to the arm assembly 40. The initial motion induced through the arm 40 is not immediately transmitted to the link 52. The reason for this being that the slot 56 permits a small shock absorbing motion to be taken up against the spring 54. Further, a three armed lever assembly 57, is pivotably suspended on a mounting stud 59 which is appropriately secured to the copier framework (not shown). The lever arm assembly 57 pivots about the stud 59 under influence of motion induced through the link 52 or opposing directional urging of the connected tension spring 60**.

In order to provide copy sheet separation, the link 52 is rotatably connected to a shoulder pin 61, which is rigidly secured to an arm 62 of the lever assembly 57. While the lever assembly 57 is rotatably suspended on the mounting stud 59, the stud 59 additionally provides co-axial support for an intermediate drive element such as the combination gear-sprocket member 63. The gear portion 64 of the member 63 simultaneously engages a pair of drive elements such as the gears 65 and 66 which are each independently rotatably suspended upon respective mounting studs 67 and 68, which are in turn appropriately secured to the arms 69 and 70 respectively of the lever assembly 57.

Rotative power is given to the gear-sprocket member 63 through connecting input provided through the drive member 36. The member 36, in addition to the endless drive member 24 are driven from a main power source such as an AC gear motor (not shown).

Since the drive member 36 is also connectively engaged with the sprocket 34 for moving the photoconductor drum 32, a common transmission source provides a direct means for registration timing control. This registration timing control is instrumental for considerations of paper registration with respect to the developed image on the drum and also in respect to the original document being scanned.

FIG. 1 further shows the main gear 63 connectively engaged to the gears 65 and 66, and the gear 65 engaged with the gear 72 which in turn is connectively engaged with a gear 74.

Gears 72 and 74 are permanently fastened to each respective end of the sheet feeding rollers 76 and 78 (FIG. 4) so that constant motion is supplied to these rollers at all times when the cams 16 are not engaged with the follower 42. As previously described, a bias spring 60 resiliently maintains the lever arm assembly 62 in a direction opposing that provided through the link 52. It then follows that the cams 16 provide the necessary control for separating the gears 65 and 72, thereby stopping the sheet feeding rollers while controlling sheet separation and forward feed at the supply stack through engagement of the gears 66 and 80. This control is maintained through a predetermined engagement of the cams 16 surface **16*a*, applied through distance $d_2$ while in engagement with the cam follower 42**.

A gear 80 is appropriately secured to separator wheel support shaft 77 which is also suitably journaled in the main copier side frames (not shown). Best seen in FIG. 3, carriage 12 is illustrated, moving from right to left in the scan mode while holding the gears 66 and 80 engaged. At this time, the separator feed wheels 81 rotate and advance a copy sheet 82 forward towards the stopped sheet feeding rollers 76 and 78.

Since the stack supply will deplete as the copier is operated, a suitable support platform biasing means is provided within the stack supply tray 83. As sheets are fed out, the bias device acting upon the stack support platform maintains a constant upward pressure against separator feed wheels 81.

Figure 3:
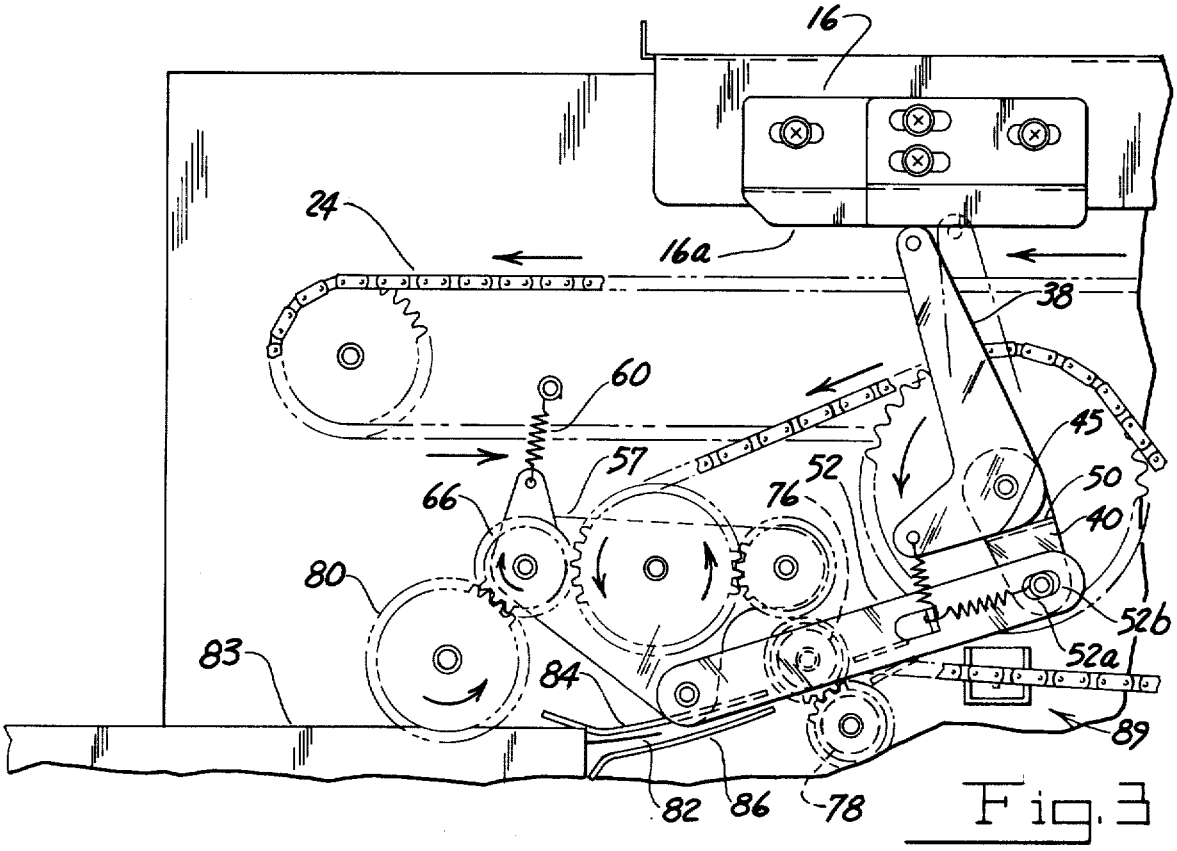
FIG. 3 is a similar to FIG. 2, illustrating parts in the position taken with the sheet feeding means inoperative and the sheet separating means operating.

Also, illustrated in FIG. 3, the separated sheet 82 is shown being guided between a set of fixed upper and lower guide members 84 and 86. These guides provide a direct intended path for the separated sheet leading towards the sheet feeding rollers 76 and 78. Like other rigid members which comprise the cross-structural foundation of the copier, the guides 84 and 86 are appropriately secured to the copier side frames at the front and rear of the machine.

Figure 4:
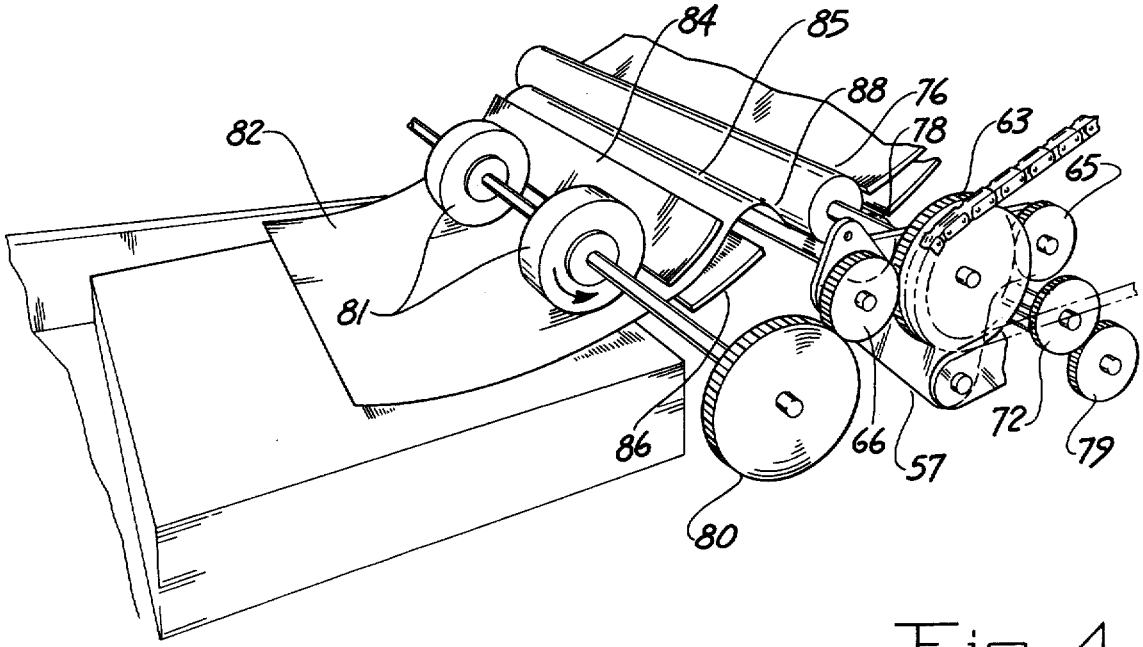
FIG. 4 is a partial perspective view showing a sheet of copy paper as it is buckled prior to being forwarded by the feeding means.

Referring to FIG. 4, the previously separated sheet 82 is now shown with a resilient buckle 85 at its leading edge 88 while the sheet feeding rollers 76 and 78 remain stopped.

Figure 5:
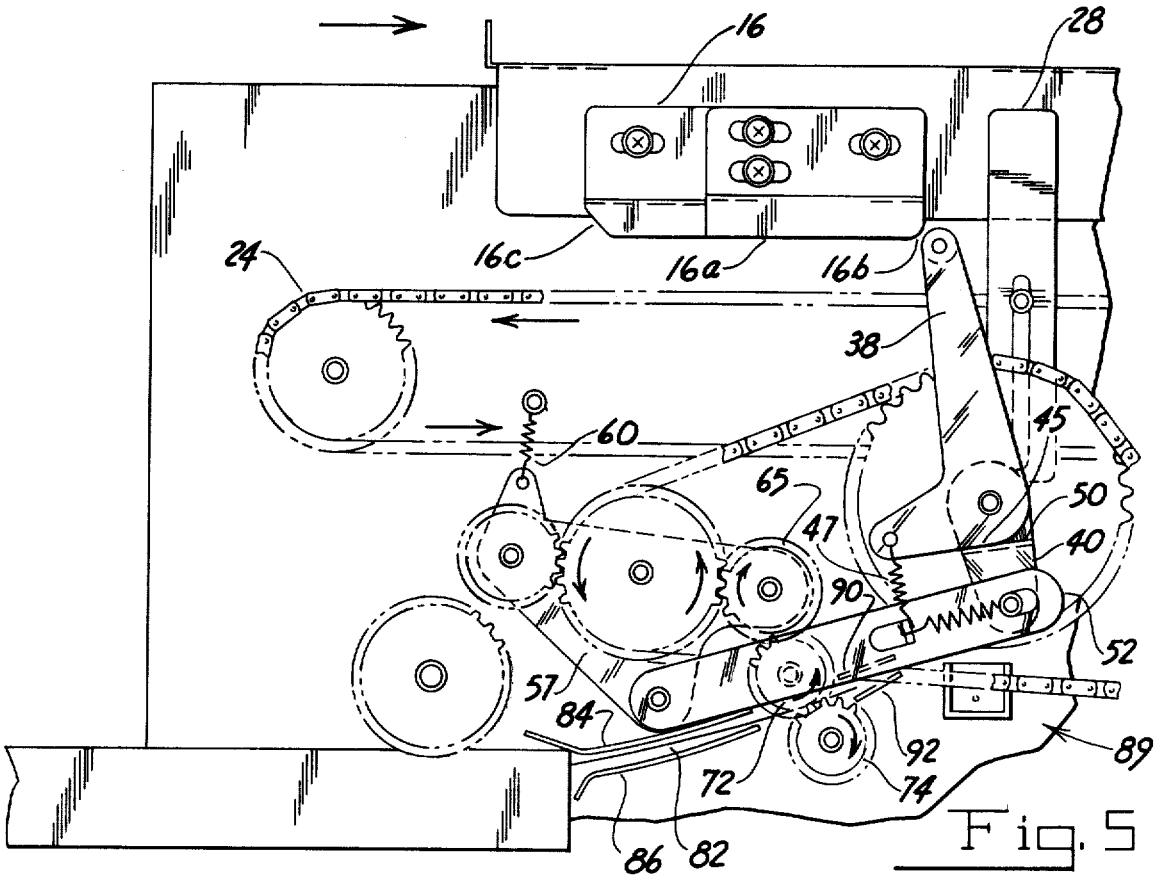
FIG. 5 is a partial front view similar to FIG. 2 illustrating the parts in the position taken with the sheet feeding means operative and feeding a sheet to the photoconductive drum.

In FIG. 5, cam follower 42 is shown just leaving the carriage cams 16, thereby permitting the gears 65, 72 and 74 to engage for the purpose of causing transport of the copy sheet forward to the transfer process area 89 which is located adjacent to the photoconductor drum 32, at a position close to 6 o'clock, with respect to the drum. The forwarding transport of the sheet is accomplished by means of the sheet feeding rollers 76 and 78 and the relieved free position of the cam follower 42, with respect to the cams 16 surface **16*c*. It follows that the companion member, lever assembly 38, and all connected parts are directionally influenced to the biased position by the tension spring 40** as previously described.

FIG. 6 illustrates a position during the return stroke of the carriage 12 where the lever assembly 38 yields in a CW direction against a bias force exerted upon the lever assembly 38 by the tension spring 47. The carriage 12 continues moving towards the right, and the follower 42 eventually leaves the cam 16 at surface **16*b*, which then allows the lever arm assembly 38 to return to a position where the surface 45 stops against the surface 50 which is part of the lever arm assembly 40**.

Throughout the entire transilatory carriage motion, the endless drive chain members 24 and 36 continuously move under power transmitted from a main input source. Also, the connected sprockets and drive members associated with the photoconductor drum and the transmission gears 63, 65 and 66 continuously rotate, and cause rotation of alternate functions when engaged with the gears 72 and 74 or 80.

Also shown in FIG. 6, copy sheet 82 is shown being guided between the guide members 90 and 92, which lead in a generally direction to the transfer zone 89 of the photoconductor drum. The guide members 90 and 92 are suitably secured to the copier side frames in a fashion similar to the guide members 82 and 84, previously described.

When the sheet has received all of the developed image at the transfer zone 89, it is further guided away from the photoconductor drum in a path leading to the fusing stage of the copier where the fixing unit completes the process of reproduction of the original document just prior to delivery to the machine operator.

While the present invention described herein has objects and advantages described in a particular embodiment, it is not intended to be limited thereby. The invention is intended to be covered within the scope of the following claims.

What is claimed is:

1. In a photocopy machine having a reciprocating carriage for moving a document past an illuminating means, a rotatable drum having a photoconductive surface thereon, means for projecting an image of the indicia on the document to the photoconductive surface, and means for developing the image on the drum and for transferring the image to a sheet of copy paper, apparatus for feeding a sheet of copy paper to the photoconductive surface in proper registration with the image thereon, said apparatus comprising:

A. sheet separating means for separating and advancing a sheet of copy paper from a supply thereof, B. sheet feeding means disposed in the feed path of the sheet being advanced of a predetermined distance from said sheet separating means and operable to define a registration gate for the sheet when said roller means is stationary and to feed the sheet to the photoconductive surface when said roller means is caused to rotate, C. drive means movable from a first position in which said drive means normally is engaged with said sheet feeding means for normally driving said sheet feeding means, to a second position in which said drive means is disengaged from said sheet feeding means and is engaged with said sheet separating means, and D. actuating means responsive to a first predetermined amount of movement of the carriage for moving said drive means from said first position to said second position to drive said sheet separating means in order to separate a sheet of copy paper from said supply and to advance the sheet of copy paper to said registration gate defined by said sheet feeding means for registration thereat, said actuating means being responsive to a second predetermined amount of movement of the carriage for moving said drive means from said second position back to said first position to discontinue driving said separating means and to drive said sheet feeding means, thereby causing said sheet feeding means to feed the registered copy sheet to the photoconductive surface of the drum in proper registration with the developed image thereon.

2. Apparatus as set forth in claim 1 wherein said drive means comprises:

A. a pair of spaced apart drive elements,

B. an intermediate drive element interposed between said spaced apart drive elements for driving the latter, C. means supporting said spaced apart and intermediate drive elements and pivotally mounted on said apparatus for movement between said first and second positions for alternately engaging said spaced apart drive elements with said sheet separating means and said sheet feeding means, and D. means for continuously driving said intermediate drive element.

3. Apparatus as set forth in claim 2 wherein said spaced apart drive elements and said intermediate drive element are disposed intermediate said sheet separating means and said sheet feeding means and said supporting means pivots about the axis of said intermediate drive element so that said spaced apart drive elements alternately engage said sheet separating means and said sheet feeding means as said supporting means pivots about said axis between said first and second positions.

4. Apparatus as set forth in claim 1 wherein said actuating means comprises a lever pivotally mounted on said apparatus, abutment means carried by the reciprocating carriage for engaging and moving said lever in one direction, and means interconnecting said lever and said drive means whereby said drive means is moved from said first position to said second position in response to said movement of said lever in said one direction by said abutment means.

5. Apparatus as set forth in claim 4 wherein said abutment means includes means maintaining said abutment means in operational engagement with said lever during said second predetermined amount of movement of the carriage in order to cause said sheet separating means to feed a sheet of copy paper to said registration gate.

6. Apparatus as set forth in claim 5 wherein said actuating means further includes biasing means for moving said lever in the opposite direction after the carriage has moved said second predetermined amount of movement and said abutment means has become disengaged from said lever so as to cause said drive means to move from said second position to said first position thereby discontinuing the drive to said sheet separating means and commencing the drive to said sheet feeding means.

7. Apparatus as set forth in claim 6 wherein said abutment means is of sufficient length to maintain said drive means in said second position for a period of time loner than that required to move the lead edge of a copy sheet to said registration gate thereby creating a buckle in said copy sheet.

* * * * *